United States Patent [19]

Osher

[11] Patent Number: 4,479,361

[45] Date of Patent: Oct. 30, 1984

[54] GAS PUMP WITH MOVABLE GAS PUMPING PANELS

[75] Inventor: John E. Osher, Alamo, Calif.

[73] Assignee: The United States of America as represented by the United States Department of Energy, Washington, D.C.

[21] Appl. No.: 471,391

[22] Filed: Mar. 2, 1983

[51] Int. Cl.[3] ..... B01D 8/00

[52] U.S. Cl. ..... 62/55.5; 55/269; 62/268; 417/901

[58] Field of Search ..... 62/55.5, 100, 268; 55/269; 417/901; 98/121 A

[56] References Cited

U.S. PATENT DOCUMENTS 2,757,840 8/1956 Weissenberg et al. ..... 62/55.5
3,210,915 10/1965 Kraus ..... 62/55.5
3,264,803 8/1966 Read ..... 62/55.5
3,771,559 11/1973 Alley ..... 98/121 A
4,198,829 4/1980 Carle ..... 62/55.5
4,295,338 10/1981 Welch ..... 62/55.5

OTHER PUBLICATIONS

Damm et al.: "Preliminary Design of a Tandem-Mirror-Next-Step Facility" (UCRL 53060), Dec. 18, 1980.

*Primary Examiner*—Ronald C. Capossela
*Attorney, Agent, or Firm*—L. E. Carnahan; Roger S. Gaither; Michael F. Esposito

[57] ABSTRACT

Apparatus for pumping gas continuously a plurality of articulated panels of getter material, each of which absorbs gases on one side while another of its sides is simultaneously reactivated in a zone isolated by the panels themselves from a working space being pumped.

20 Claims, 10 Drawing Figures

GAS PUMP WITH MOVABLE GAS PUMPING PANELS

DESCRIPTION

The United States Government has rights in this invention pursuant to contract number W-7405-ENG-48 between the United States Department of Energy and the University of California, for the operation of Lawrence Livermore National Laboratory.

The present invention relates generally to gas pump apparatus in which gas is removed from a spaced through capture by gas pumping members and, more particularly, to a gas pump apparatus having gas pumping members which are movable between at least two positions, one of which isolates gas pumping members from the space for reactivation.

Before the advent of gas capture pump apparatus, such as cryogenic, sorption and getter gas pumps, diffusion and turbomolecular transport pumps were employed to establish low pressures in a high vacuum space. The final pressure attainable in the high vacuum space with such transport pumps, however, is limited because of contamination of the high vacuum space by the working fluid of the transport pumps or of the associated apparatus of the pumping system in which transport pumps are used. Such contamination results from the backflow of working fluid from the transport pump or associated apparatus to the high vacuum space.

Cryogenic, sorption, gettering and like gas capture pump apparatus have the advantage of functioning without a contaminating working fluid. Such pumps remove gas from a space by capturing the gas on gas pumping members placed in gas flow communication with the space. Cryogenic pumps rely on condensation of the gas on a temperature controlled surface. In such devices, pumping occurs as long as the operating pressure of the space proximate the gas pumping member surface is higher than the saturated vapour pressure at the temperature of the surface. Sorption and gettering devices rely upon either physical absorption or gettering. In such devices, pumping occurs if sites are available on the surface of the gas pumping member where atoms of the gas and atoms of the pumping member can become attached by polar forces (absorption) or can react (gettering). While such gas capture pump apparatus do not suffer from backflow contamination produced by foreign working fluid substances as in the aforedescribed transport pumps, they have not heretofore been capable of continuous pumping without periodically exposing the space being pumped to contamination from previously captured gas, which is a form of backflow. More specifically, as will be appreciated from the foregoing, gas capture pump apparatus do not remove the pumped gas from the system in pumping a space, but attach gas to a surface in the system. Condensation pumping stops when the thermodynamic equilibrium between the condensate covered pumping surface and the pumped gas' saturated vapour pressure is reached. Absorption and gettering pumping stops when the pumping surface is saturated with pumped gas. Ordinarily, however, gas capture pumps become ineffective before such condition is reached, because the increasing captured gas load placed on the pumps, as this condition is approached, reduces the pumping efficiency of such pumps to the extent that the rate of removal of gases from the space being pumped is too low for effective pumping of the space.

Cryogenic gas pump apparatus relying solely on condensation for gas capture efficiently pump virtually all gases, except hydrogen and its isotopes. Thus, in systems where a low hydrogen gas partial pressure is desired under conditions of high system gas throughputs, e.g., as in plasma containment devices for confining thermonuclear fusion reactions, other gas capture pump apparatus are often preferred. For example, sorption and getter pump apparatus can efficiently pump hydrogen gas, including its isotopes.

Unfortunately, the pumping capacity of getter and sorption pumps are limited by the aforementioned saturation effect. To effect efficient continuous pumping of a space with either a getter or sorption pump apparatus, or any other gas capture pump apparatus, or a combination of such pump apparatus, it is necessary to reactivate the gas capture pumping surfaces. Reactivation is a process that liberates the captured gas species to return the pumping surfaces to a state of optimum pumping performance. The captured gas species are liberated by warming the pumping surfaces and exhausting the liberated gases with a mechanical pump to the exterior of the space being pumped. The reactivation process is often carried out whenever the pumping speed of the system, hence, pumping efficiency, is reduced below an acceptable level as a result of the captured gas load on the pumping surfaces approaching their gas capturing capacity. In addition, the reactivation process is also often performed on a periodic basis regardless of the pumping speed of the system. In either case, the gas pumping operations of available gas capture pump apparatus are interrupted during the reactivation process and many of the available pumps are reacativated without isolation of the pumping members from the space being pumped.

Interruption of the gas pumping operations hinders maintenance of a desired steady state pressure in the space being pumped. Maintenance of a steady state pressure is becoming increasingly important in plasma containment devices, such as thermonuclear fusion reactors, which are characterized by atmospheres of extremely pure low neutral gas densities. Present thermonuclear fusion reactors being designed to operate in a steady state pressure mode require large gas throughput to achieve the desired atmospheres. This requires vacuum pumping systems also having steady state capability as well as a large gas throughput, low backflow and high pumping speed characterics productive of the desired steady state pressure operating condition.

With respect to the failure to isolate the pumping members during their reactivation, it will be appreciated that the resulting backflow of liberated gases undesirably and harmfully contaminates the reactor grade plasma. Such contamination leads to inefficient operation of the fusion reactor by virtue of heat losses and can prevent loss of proper plasma conditions for sustained fusion reactions, if the backflow is excessive.

Several approaches to the maintenance of steady state pressure conditions have been implemented, but all are found wanting in one or more respects. A common approach is a system of multiple appendaged vacuum pumps having at least two valve isolated vacuum pump stages, with each stage adapted to achieve a desired pressure level in the vessel to be evacuated. The vacuum pump stages are sequentially coupled in gas flow communication, i.e., a coupling that provides an unimpeded path for transmission or flow of gas, with the vessel through the appropriate manipulation of the isolation valves. While such systems are capable of initially achieving a desired final pressure on a continuous pumping basis, the final vacuum pump stage is unable to maintain the final pressure without reactivation of the gas pumping members. If the pumping members are not isolated from the vessel being pumped during reactivation, the aforedescribed undesirable backflow to the vessel results. Alternatively, if the pumping members of the final vacuum stage are isolated, the pumping of the vessel is undesirably interrupted. An exemplary multiple appendaged vacuum pump system of this type is described in U.S. Pat. No. 2,757,840 to Gustav Weissenberg et al.

Another multiple appendaged vacuum pump system is described in U.S. Pat. No. 3,264,803 to Philip L. Read. As discussed with reference to the Weissenberg et al patent, the vessel being pumped is disconnected from the Read vacuum pump system while the final sorption pump stage is reactivated to liberate and exhaust captured gas. Consequently, the vacuum pump system described in the Read patent is characterized by the same shortcomings discussed with reference to the Weissenberg et al patent.

A plurality of appendaged pumps often are used to avoid interruption of the pumping of a vessel so that a desired final pressure can be maintained in the vessel on a continuous basis. This has been achieved by coupling each appendaged pump to the vessel through a separate isolation valve and operating the valves so that one appendaged pump is always coupled to pump the vessel while the other appendaged pumps are isolated for reactivation. In such multiple appendaged pump systems, each appendaged pump must have a pumping capacity capable of maintaining the vessel at the desired final pressure. While such pump systems avoid undesirable interruption of pumping of the vessels and backflow to the vessel discussed above with respect to the Weissenberg et al and Read patents, they are characterized by duplication of pumps, pump capacity and isolation valves, being large in size and requiring manipulation of several system controls in the proper sequence, all of which make such systems undesirable, particularly, for use in sustained fusion reaction machines.

A two stage cryogenic pumping apparatus is described in U.S. Pat. No. 4,295,338 to Kimo M. Welch in which the pumping members are removed and replaced when they become contaminated. This necessarily requires returning the pumped vessel to atmosphere. Of course, this prevents operating the cryogenic pumping apparatus described in the Welch patent on a continuous pumping basis.

A two stage combined condensation and sorption pump is described in the U.S. Pat. No. 4,198,829 to Jacques Carle in which the condensation stage surrounds and shields the sorption stage until only incondensable gas species remain in the vessel being pumped. Once this condition is reached, the pumping members of the condensation stage are moved to expose the pumping members of the sorption stage, which capture and remove the remaining incondensable residual gas species remaining in the vessel. The final pressure of the vessel is determined by the sorption stage. Therefore, the sorption stage must remain in continuous gas flow communication with the vessel and continue effective pumping of the vessel, if the final pressure is to be maintained under vessel operation conditions which continuously produce unwanted contaminents. Should the sorption stage approach its gas capturing capacity, it will be unable to maintain the desired final pressure in the vessel. If reactivation is attempted with the two stage pump in gas flow communication with the vessel being pumped, the liberated gas will flow back into the vessel, contaminating the vessel space and altering the pressure therewithin. Even if backflow of liberated gas to the vessel could be avoided, the sorption stage would not continue effective pumping of the incondensable gas species during the reactivation process. Consequently, the desired final pressure level of the vessel would not be maintained by a two stage pump constructed and operated in accordance with the teachings of the Carle patent.

U.S. Pat. No. 3,210,915 to Thaddaus Kraus described a sluicing sorbent gas pumping apparatus capable of continuously pumping a space without interruption for reactivation operations or exposing the pumped space to contaminants liberated by reactivation of the pumping medium. However, in accordance with the teachings of the Kraus patent, such continuous pumping is achieved by the cumbersome technique of delivering a continuous stream of loose, granular sorbent through a pump chamber in gas flow communication with the space being pumped. Not only is the technique cumbersome and fraught with difficulties of implementation, such technique imposes severe limitations on the use of the pumping apparatus, particularly, with respect to its physical orientation. More specifically, the pumping apparatus must be arranged in an orientation relative to the flow of the stream of loose, granular sorbent material so that the flow is restricted to the desired path and the material is prevented from straying throughout the pump system and pumped vessel.

Recently, a gas pump apparatus was developed which permits gas pumping members to be reactivated to return them to a state of optimum pumping performance while the space from which contaminants are to be removed is continuously pumped to maintain a desired final steady state pressure. This gas pump apparatus is the subject of a U.S. patent application Ser. No. 476,309 (IL-7068), filed on 3/17/83, entitled Continuously Pumping and Reactivating Gas Pump, by Thomas H. Batzer and Wayne R. Call, and assigned to the same assignee as this application. The gas pump apparatus described in the Batzer et al application includes a plurality of sets of large gas pumping panels coupled directly in gas flow communication with the vessel defining the space being pumped and with a gas exhaust system that removes captured gas liberated from the gas pumping panels during the reactivation of the panels. The gas pump apparatus is arranged so that a number of the sets of gas pumping panels defining a selected pumping capacity are always in communication with the space defined by the vessel for gas pumping purposes, while at least one other set of panels defining a pumping capacity equal to a fraction of the selected pumping capacity is isolated from the space by a set of thermal shield members so that reactivation of the isolated panels can be performed without undesirable backflow to the space being pumped. As used herein, the term isolated or other forms of isolate when used to specify separation from a space being pumped means a setting apart from the space under a gas seal condition that prevents undesirable gas flow into the space from the isolated zone. As will become more apparent upon consideration of the following detailed description of preferred embodiments of the gas pump apparatus of the present invention, a seal forming an impedance to gas flow from an isolated gas pumping surface to the space being pumped which limits any flow of captured gas to the space during reactivation to an insignificant level, namely, no more than a few percent of the captured gas load of the isolated gas pumping surface being reactivated, provides the desired isolation between the space and the isolated gas pumping members.

In the gas pump apparatus described in the Batzer et al application, each of the sets of gas pumping panels includes a plurality of gas capture pumping panels that serves to capture and remove gas from the pumped space. In addition, each of the sets of gas pumping panels are operatively associated with a cooperating set of thermal shield members that are selectively moved between two positions to expose and isolate selectively the set of gas pumping panels relative to the space being pumped. In the Batzer et al apparatus, the shield members must be provided not only to isolate the operatively associated gas pumping panels from the space being pumped, but to shield the pumping panels from thermal radiation from the surroundings because cyrogenic gas pumping panels are employed. Two cooling systems are used; one for the cyrogenic gas pumping panels, and one for the thermal shield members. Cryogenic cooling systems are characteristically space consuming and, in the Batzer et al apparatus, also complex because of their use in controlling the reactivation of the gas pumping panels. Moveover, the provision of a number of sets of gas pumping panels in excess of that required to define a selected pumping capacity so that at least one set of the panels can be isolated for reactivation requires more real estate than would be required if the number of panels were limited to that needed to define the selected pumping capacity.

Although the gas pump apparatus described in the Batzer et al application offers many advantages over other gas pumping systems heretofore used to achieve and maintain a desired final pressure in a defined space, the gas pump apparatus of the present invention offers additional benefits not realizable with the Batzer et al apparatus, while retaining the many benefits that such apparatus provides over other prior art gas pump apparatus. As will be appreciated from the description of the preferred embodiments of the gas pump apparatus of the present invention, the aforedescribed limitations and cumbersomeness characterizing continuous sluicing gas pump apparatus, such as described in the aforementioned Kraus patent, are avoided by the structure of the gas pump apparatus of the present invention. Such desirable features are realized in the gas pump apparatus of the present invention in a relatively compact structural arrangement that is not limited as to configuration or physical orientation and avoids substantial duplication of gas pumping equipment and the requirement to manipulate several system controls in operating the apparatus to achieve and maintain a steady state pressure condition in the space being pumped.

The foregoing advantages and benefits are realized in the gas pump apparatus of the present invention through a movable gas pumping member defining a gas capture pumping surface having a plurality of surface portions. The gas pumping member is mounted for movement between at least two positions. While in a first of the two positions, at least a first surface portion of the gas capture pumping surface is positioned in gas flow communication with the space to be pumped for capturing gas to be removed from the space. At the same time, at least a second surface portion of the gas capture pumping surface is positioned to be isolated from the space being pumped, whereby it may be reactivated without affecting the space. When the gas pumping member is moved to the second of the two positions, the first surface portion of the pumping surface is positioned to be isolated from the space for reactivation, while the reactivated second surface portion is positioned in gas flow communication with the space to be pumped for capturing gas. Continued periodic movement of the gas pumping member permits continuous pumping of the space for virtually an unending period.

For applications requiring the pumping of large volumes of gas, an array of such gas pumping members are provided, each being moved between its various positions either independently of or conjointly with the other gas pumping members of the array. Furthermore, the gas pump apparatus of the present invention is able to employ the structure of the gas pumping member itself to form a barrier for isolating the portions of its gas capture pumping surface from the space being pumped. The preferred embodiments of the gas pumping apparatus of the present invention illustrated in the drawings are arranged for pumping large volume, high temperature plasma confinement chambers, such as found in thermonuclear fusion reactors. These embodiments make advantageous use of gas pumping members having gettering gas capture surfaces. As discussed hereinbefore, gettering devices are available that can efficiently pump hydrogen and its isotopes. This is an important feature in thermonuclear fusion reactor pumping applications, because such reactors generate a high hydrogen and hydrogen isotope gas throughput. In addition, gettering devices typically are operated at elevated temperatures. Such operation obviates the need to provide protective thermal shields, as is the case when cryogenic gas pump apparatus are employed to pump thermonuclear fusion reactors. Moreover, such gettering devices have the advantage of retaining captured gas until its getter material is raised to a reactivation temperature exceeding its elevated gas capture temperature. Thus, an operating failure in or shut-down of such gettering devices that results in the lowering of the operating temperature of the getter material will not cause the release of the captured gases to the space being pumped. This is in contrast to what can occur upon an operating failure in or shut-down of cryogenic gas pump apparatus that results in the raising of the normally low operating temperature of such apparatus. Raising the operating temperature of a cryogenic gas pump apparatus above its low gas capture operating temperature will cause the undesirable release of the captured gas to the space being pumped.

The foregoing and other features and advantages of the gas pump apparatus of the present invention will become more apparent upon consideration of the following detailed description of preferred embodiments of the invention and appended claims taken together with the accompanying drawings in which:

Figure 1:
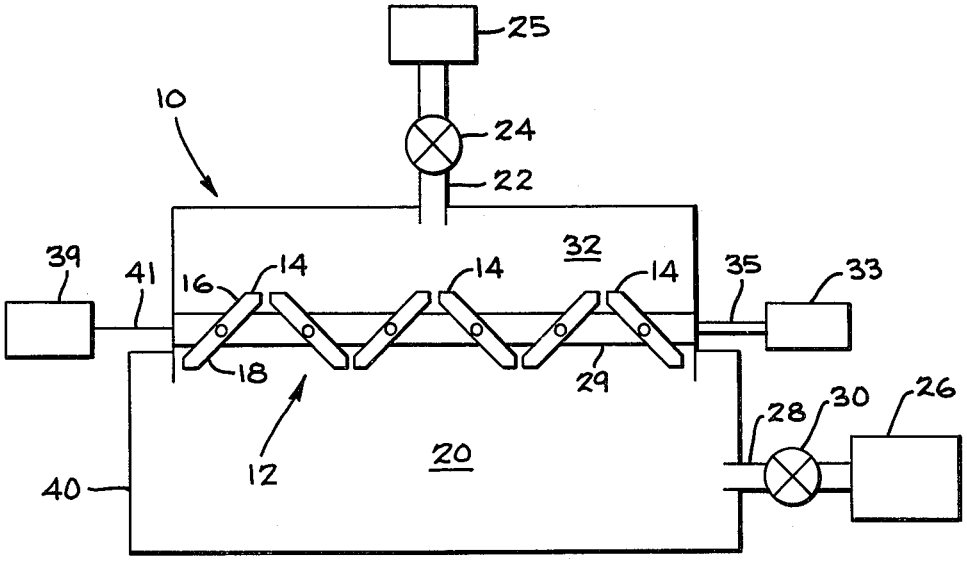
FIG. 1 is a schematic diagram of a vacuum pump system employing the gas pump apparatus of the present invention.

Broadly and with reference to FIG. 1, the gas pump apparatus 10 of the present invention includes an array 12 of movable gas capture pumping members 14, with each member having multiple pumping surfaces 16 and 18. In the preferred embodiments illustrated in FIGS. 2–7, each pumping surface 16 and 18 is defined by a separate gas capturing pumping element. The gas pumping members 14 are disposed in gas flow communication with a space 20 containing an atmosphere of gas to be pumped and maintained at a selected final pressure. The gas pump apparatus 10 of the present invention will be described in detail with reference to the preferred embodiments illustrated in FIGS. 2–7 arranged to evacuate the space 20 to and maintain it at an ultrahigh vacuum for an extended period suitable for continuously sustaining thermonuclear fusion reactions in a prolonged steady state pressure mode. For such applications, the gas pump apparatus 10 is fabricated, configured and dimensioned for high gas volume vacuum pumping operations. It will be appreciated, however, the gas pump apparatus 10 of the present invention is suited for other vacuum pumping applications not as demanding as such thermonuclear fusion applications and for gas pumping applications at elevated pressures in excess of one atmosphere. For applications other than that for which the preferred embodiment of the gas pump apparatus 10 is arranged, the pump apparatus is fabricated, configured and dimensioned according to the needs of the application.

In addition to communicating with the space 20, the gas pump apparatus 10 is coupled in gas flow communication via a gas exhaust duct 22 and gas exhaust valve 24 to an auxiliary exterior gas pump exhaust apparatus 25 of conventional design for exhausting captured gases liberated from the gas capture pumping members 14 during reactivation of the elements 16 and 18 of the members in the manner permitted by the gas pump apparatus 10 of the present invention. Reactivation of elements 16 and 18 of the pumping members is facilitated by including in the gas pump exhaust apparatus 25 a gas collector pump located between the gas pump apparatus 10 and a mechanical gas pump. Gas collector pumps are operable to effect rapid transfer of gases liberated from the gas capture pumping members 14 of the primary gas pump apparatus 10 during their reactivation. The transferred gases are held by the gas collector pump for convenient exhausting to the exterior without effecting the operation of the primary gas pump apparatus 10.

As will be described in further detail hereinbelow, gettering gas capture pumping elements efficiently and reversibly sorb hydrogen and its isotopes. The particular gettering material preferred is a zirconium-aluminum alloy, which can be contaminated by other active gases, such as oxygen, carbon dioxide and nitrogen. To avoid the undesirable contamination of the gas capture pumping members 14, as well as to facilitate rapid pumping of the space 20 to the desired final pressure and maintaining that pressure for prolonged periods, it is desirable to fore pump the space 20 to an initial medium pressure i.e., about $1\times10^{-3}$ torr. Usually, this is accomplished by an exterior diffusion pump apparatus 26 of conventional design communicated with the space 20 via a fore pump duct 28 and fore pump valve 30.

In the preferred embodiment of the gas pump apparatus 10 of the present invention, reactivation of the gas capture elements 16 and 18 forming the pumping members 14 is accomplished by controlling the temperature of the gas capture elements 16 and 18. The preferred embodiment utilizes getter capture pumping elements 16 and 18 to effect the desired removal of gas species from the space 20. It will be appreciated however, the gas pump apparatus 10 of the present invention can employ gas capturing elements that rely on gas capturing mechanisms other than sorption whose pumping performance is enhanced or is dependent upon reactivation of the gas capturing elements. The temperature of the sorption gas pumping elements 16 and 18 can be controlled various ways, including by controlled passage of electrical current through heating elements embedded or otherwise secured to the gas pumping elements or by controlled radiation of thermal energy to the pumping elements from an infrared heat source located proximate the pumping elements. In embodiments of the gas pump apparatus 10 of the present invention employing cryogenic gas capture pumping elements cooled by a cooling fluid, the temperature of the gas pumping elements 16 and 18 can be controlled by altering the delivery of cooling fluid to the array 12 of pumping members 14.

The gas pump apparatus 10 is illustrated in FIG. 1 as having a particular organization and form of elements as well as a particular operating relationship with the space 20 being pumped. As shown in FIG. 1, the space 20 is defined by the walls of a vessel 40 and the gas pump apparatus 10 is depicted as forming a barrier in the nature of a wall within the vessel 40 that separates the space 20 from a reactivation zone 32. However, there is no limitation respecting the configuration, dimensions or numbers of the gas pumping members (other than the space available for their location and needed capacity of the pumping apparatus) and the gas pump apparatus 10 may be fabricated as an appendage pump or as part of the vessel or the gas system being pumped, as depicted in FIG. 1.

Figure 2:
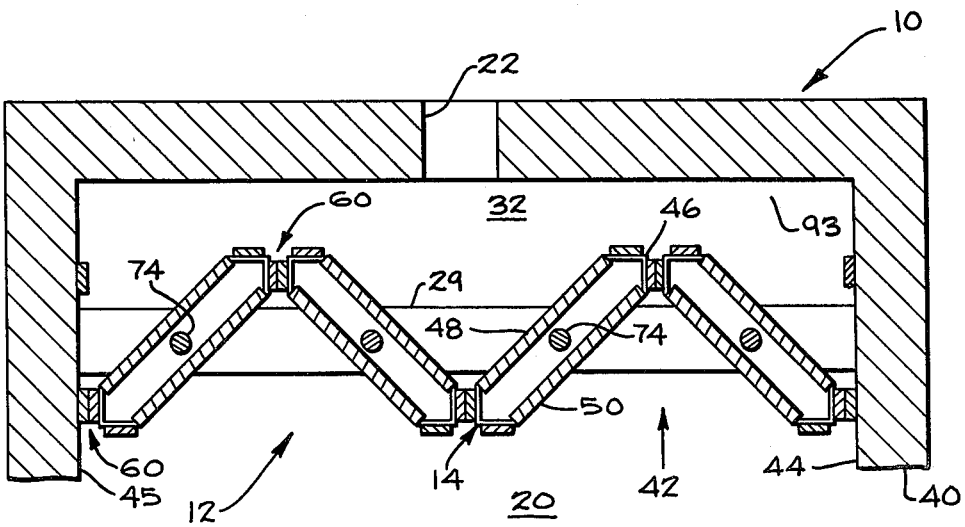
FIG. 2 is a cross-sectional view of one preferred embodiment of the gas pump apparatus of the present invention.

As briefly discussed hereinbefore, the gas pump apparatus 10 of the present invention includes an array 12 of gas pumping members 14 each having a plurality of gas pumping surface 16 and 18. Each gas pumping member 14 is mounted for movement between at least two positions. As will be described in further detail hereinafter with reference to FIGS. 5A and 5B, the gas pumping members 14 are moved between the two positions by a motor 33 that is coupled by a drive shaft 35 to a chain drive mechanism 37 (FIG. 5A) carried in the housing 29 and linked to the gas pumping members 14. While in a first of the two positions, a first surface 18 of the plurality of gas pumping surfaces is positioned in gas flow communication with the space 20 to be pumped for capturing gas to be removed from the space. At the same time, the second surface 16 of the plurality of gas pumping surfaces is positioned to face the reactivation zone 32 and be isolated from space 20. As will be explained in further detail hereinafter with reference to FIGS. 2 and 4, isolation is achieved by forming a wall across the entire opening into the reactivation zone 32 with gas pumping members 14 and forming a gas tight seal between adjacent gas pumping members that inhibits the flow of gas at objectionable levels between the zone 32 and space 20. The aforedescribed positioning of the gas pumping members 14 is illustrated in FIG. 1. When the array of gas pumping members 14 is moved by operation of the motor 33 to the second of the possible gas pumping member positions, the positions of the gas pumping surfaces 16 and 18 are reversed. In the new positions, the reactivated pumping surfaces 16 are positioned to pump space 20 while the gas loaded surface 18 is positioned in gas flow communication with the reactivation zone 32 for removal of captured gases and preparation for reuse as a gas pumping element. This positioning of the gas pumping surfaces 16 and 18 is the reverse of that illustrated in FIG. 1. As will be described in further detail with reference to FIG. 6, the gas pumping surfaces of getter material are reactivated by raising the temperature of the getter material. This is achieved by increasing the current through electrical conductors embedded in the getter material, which current is furnished by a power supply 39 coupled to the embedded conductors by the electrical cable 41. Continued periodic movement of the plural surfaced gas pumping member between the two positions permits continued pumping of the space 20 for as long as desired.

Referring now to FIG. 2, the gas pump apparatus 10 of the present invention is illustrated as embodied to be a part of the vessel 40 being pumped. More specifically, an array 12 of multiple surfaced gas pumping members 14 are distributed across an opening 42 of a re-entrant defined by the interior wall 44 and 45 of the vessel 40. The gas pumping members 14 are disposed in a folded pattern so as to increase the pumping area of the members, hence, capacity of the gas pump apparatus 10. In the preferred form of the gas pump apparatus embodiment show in FIG. 2, each gas pumping member 14 is formed by a pair of elongated rectangular panels 48 and 50 of getter material mounted to a rotatably supported framework 46 to face in opposite directions. The panels are constructed of gas sorbent getter material, preferably, a zirconium-aluminum alloy, and extend with their long dimension in the direction of view of the observer of FIG. 2.

Several of such gas pumping members 14 are distributed across the opening 42 to define the pumping surface reactivating zone 32 within the volume defined by the vessel 40, which is isolated from the space 20 being pumped by the gas pumping members themselves. The desired isolation is perfected by gas tight seals 60 between adjacent gas pumping members 14 and between any gas pumping member and an adjacent wall, such as walls 44 and 45, of the vessel 40. In large plasma confinement chambers operated at a steady state pressure on the order of $1\times10^{-8}$ torr or less, it is not necessary to provide gas impervious seals. The gas seal need only be sufficient to prevent backflow from the reactivating zone 32 to the working space 20 that produces an objectionable change in the steady state pressure condition of the space. Increases in pressure due to backflow by a factor of two usually is considered insignificant and tolerable.

Figure 3:
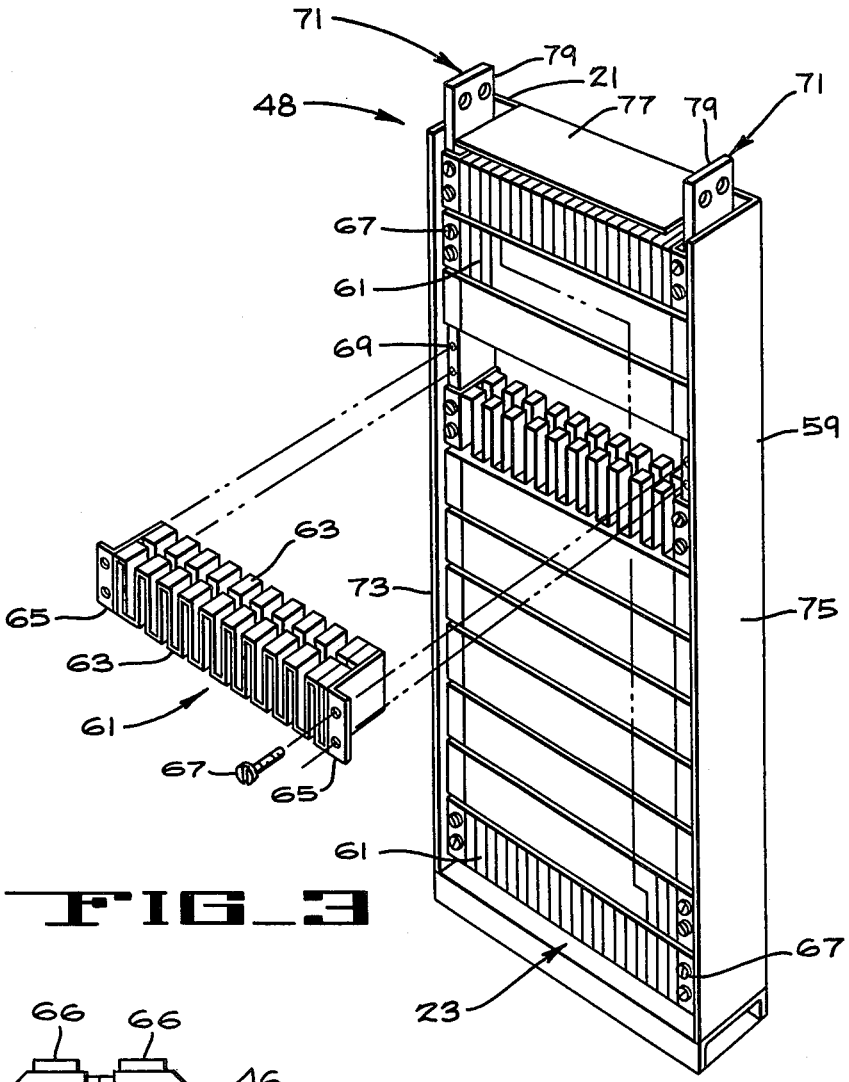
FIG. 3 is a perspective view of the gettering panel employed in the preferred embodiment of the gas pump apparatus of the present invention.
Figure 6:
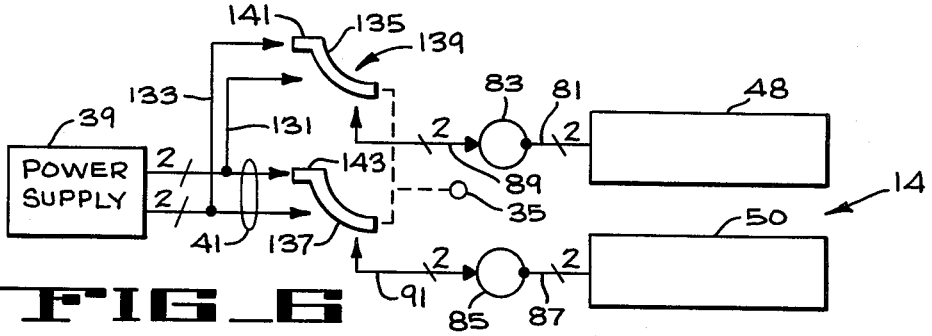
FIG. 6 is an electrical schematic diagram of the gettering panel operating circuit.

FIG. 3 illustrates a preferred embodiment of the getter panel, for example, 48, employed in the gas pumping members 14 of the gas pump apparatus 10. Each getter panel 48 includes a rectangular frame 59 within which several modules 61 of getter material are disposed. The frame 59 has one closed side 21 for isolating the getter modules 61 and one open side 23 for exposing the getter modules. Each getter module 61 includes two ribbons 63 of getter material extending side-by-side in a serpentine fashion between two mounting brackets 65 of electrically conductive material. As briefly mentioned hereinbefore, the getter material has electrical conductors (not shown) embedded within it for conducting current through each ribbon 63 to heat the getter material to its required operating temperature. The embedded conductors are exposed at the opposite ends of each ribbon 63 and are electrically connected to the mounting brackets 65, which serve to provide conducting paths for current to the ribbon. Each getter module 61 is mounted within the frame 59 by bolts 67 extending through the brackets 65 to engage threaded holes 69 along one edge of each of a pair of electrical bus bars 71. The electrical bus bars 71 are located along opposite long sides 73 and 75 of the frame 59 and extend beyond one end 77 of the frame to form a pair of electrical terminals 79. The terminals are electrically connected by an electrical cable 81 (FIG. 6) carried by the framework 46 (FIG. 2) to a slip ring assembly 83. The slip ring assembly enables the getter modules 61 of the rotatably mounted gas pumping members 14 to be electrically connected to the electrical cable 41 extending to the power supply 39. The electrical conductors embedded in the ribbons of getter material forming the getter panel 50 carried by the same framework 46, but facing in a direction opposite the getter panel 48, are coupled to the power supply 39 by a separate slip ring assembly 85 and electrical cable 87 (FIG. 6). Each of the slip ring assemblies 83 and 85 have a rotatable portion, which rotates with the rotatable framework 49, and a stationary portion with respect to which the rotatable portion moves, which can be fixed to non-rotating parts of the gas pump apparatus 10. The stationary part of all slip ring assemblies 83 associated with the gas capture elements 16 (which face a common direction relative to the space 20) are electrically coupled to the same electrical cable 89 for coupling to the power supply 39. Similarly, the stationary part of all slip ring assemblies 85 associated with the gas capture elements 18 (which face in a common direction relative to the space 20) are electrically coupled to the same electrical cable 91 for coupling to the power supply 39.

A getter panel of the kind illustrated in FIG. 3 that is suitable for use in the gas pump apparatus 10 of the present invention is marketed by SAES GETTERS S.P.A. under the trademark St 101. The getter material used in St 101 getter panel is a zirconium-aluminum alloy having a sorption operating range of 200 to 400 degrees centigrade and a reactivation temperature in the range of 400 to 700 degrees centigrade.

Figure 4A:
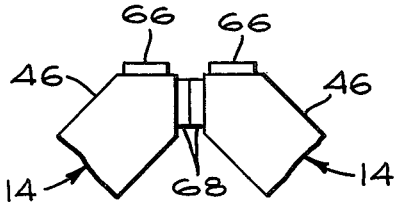
FIGS. 4A, 4B and 4C are schematic diagrams of exemplary flexible metal seal embodiments that can be employed in the gas pump apparatus of the present invention to isolate the space being pumped from a gas pumping member reactivation zone.
Figure 4B:
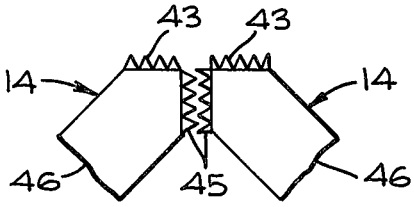
Figure 4C:
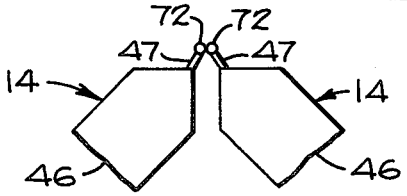

Referring now to FIGS. 4A through 4C, various embodiments of gas tight seals are illustrated that are suitable for use in gas pump apparatus 10 of the present invention, for example, as seals 60 in the embodiment of the apparatus illustrated in FIG. 2. In FIG. 4A, for example, each of the frameworks 46 of adjacent gas pumping members 14 is provided with a pair of flexible metal seal members 66 and 68 at and extending the length of opposite ends of the framework 46. The flexible metal seal members are positioned on each framework 46 so that they engage a corresponding flexible metal seal (either secured to the framework of an adjacent gas pumping member 14 or secured to an adjacent wall of the vessel 40) when the gas pumping member 14 is in either of its two positions. FIG. 4B illustrates an alternative interlocking seal mechanism mounted to the framework 46. A pair of interlocking metal teeth members 43 and 45 is fastened to each end of each framework 46 to extend the length of the framework. The teeth members 43 and 45 form a gas tight seal when interlocked and function like the flexible metal seal members 66 and 68 of FIG. 4A in isolating the reactivating zone 32 from the space 20 being pumped. FIG. 4C illustrates another embodiment of gas tight seal that can be used in gas pump apparatus 10 of the present invention. More specifically, a bar 47 is fastened to extend from each end of each framework 46 to a single flexible rod 72 that extends the length of the framework 46. The rod 72 is orientated relative to the other flexible metal rods located at adjacent vessel walls 44 or 45 or at adjacent frameworks 46 to always be in engagement with the other flexible metal rod whenever the gas pumping member 14 is in one of its two positions. Each of the aforedescribed gas tight seals produce the desired sealing condition through pressure contact forces. The ends of the frameworks 46 extend to a pair of housings 29 (one of which is seen in FIG. 2), one mounted at each of the opposite walls 93 of the vessel 40 (one of which is seen in FIG. 2). In large plasma confinement chambers, the ends of the frameworks can be sealed satisfactorily against undesirable gas backflow from the reactivation zone 32 to the working space by fabricating the frameworks 46 so that the separation between their ends and the adjacent walls 93 (or housings 29) is on the order of a few hundredths of a millimeter. Alternatively, sealing can be enhanced by fastening flexible sliding metal seal members to the ends of the framework 46 to bear against the walls 93 and housing 29 along the extent of each framework when the gas capture pumping members 14 are in either of their two positions. Properly dimensioned and located frameworks 46 and seals 60 (FIG. 2) will establish a gas tight seal between the reactivation zone 32 and the space 20 being pumped that prevents unacceptable backflow from the reactivation zone to the pumped space.

Figure 5A:
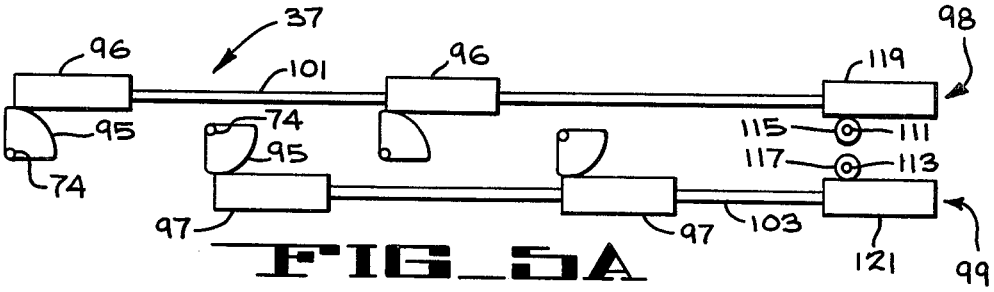
FIGS. 5A and 5B are schematic diagrams of the sprocket drive mechanism for the movable gas panels employed in the preferred embodiment of the present invention.
Figure 5B:
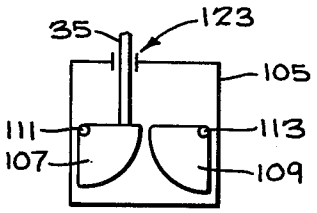

Attention is now directed to FIGS. 2 and 5. As described hereinbefore, the gas pumping members 14 are mounted for movement between two positions for selectively isolating from and exposing to the working space 20 the gettering panels 48 and 50 carried on opposite sides of the members 14. More specifically, the pumping members 14 of the entire array 12 are articulated simultaneously between the two positions, with adjacent ones of the members articulated in opposite directions. The manner in which the gas pumping members 14 are articulated will be appreciated by referring to FIGS. 5A and 5B. Each gas pump member 14 is supported for articulation by a shaft 74 extending in the direction of the length of the member and into the housing 29 through the wall of the housing facing the gas pumping member 14. The end of the shaft 74 carries a quarter segment of a sprocket 95, which engages a chain segment 96 or a chain segment 97 of two chains 98 and 99, respectively, of the chain drive mechanism 37. Alternatively, geared rod segments can be used instead of chain segments. The chain segments 96 of the chain 98 are linked by chain segments 101 that are smaller in diameter than the segments 96, whereas the chain segments of the chain 99 are similarly linked by the smaller diameter chain segments 103. The two chains 98 and 99 are driven in the same direction so that the sprockets 95, hence, shafts 74, they respectively engage are rotated in opposite directions. The sprockets 95 coupled to adjacent gas pumping members 14 engage different ones of the claims 98 and 99. Consequently, the adjacent gas pumping members 14 are articulated in opposite directions by virtue of being driven by the different chains.

FIG. 5B illustrates the manner in which the motor 33 (FIG. 1) is coupled to drive the chains 98 and 99 in the desired same direction. More particularly, the drive shaft 35 extends from the motor 33 into a housing 105 in which a quarter segment drive gear 107 and quarter segment driven gear 109 are located. Each of these gears are fixed to one of the ends of one of the shafts 111 and 113, respectively. As the gears 107 and 109 are rotated, the associated shafts 111 and 113 are similarly rotated. As can be seen from FIG. 5B, the gears 107 and 109, hence, their respective shafts 111 and 113, rotate in opposite directions when the drive gear 107 is driven by the motor 33. The housing 105 is mounted outside the vessel 40 relative to the chain drive mechanism 37 so that the shaft 111 extends from the drive gear 107 through wall 93 of the vessel to its opposite end, which is fixed to a chain drive sprocket 115 (FIG. 5A). Similarly, the shaft 113 extends from the driven gear 109 through the vessel wall 93 to its opposite end, which is fixed to another chain drive sprocket 117 (FIG. 5A). The two chain drive sprockets 115 and 117 engage adjacent chain segments 119 and 121, respectively, whereby the chains 98 and 99 are driven in same direction when drive and driven sprockets 107 and 109 are rotated in opposite directions by the translated drive shaft 35.

Returning to FIG. 5B, the drive shaft 35 is translated back and forth by the motor 33 (FIG. 1) to rotate the drive and driven gears 107 and 109 in opposite directions. The drive shaft 35 extends into the housing 105 through a gas tight seal 123 and its end is fastened to an arm (not shown) that is fixed to the shaft 111 of the drive sprocket 107. As the drive shaft 35 is translated by the motor, the arm, hence, shaft 111, is rotated. The shaft 113 is rotated in a direction opposite to the shaft 111 by the coupled gears 107 and 109. This results in aforedescribed driving of the chains 98 and 99 in the same direction.

As discussed previously, sorption pumping by and reactivation of the getter panels 48 and 50 is controlled by the current provided to panels by the power supply 39. FIG. 6 is a schematic diagram of circuitry for accomplishing this current control. One of the two getter panels 48 and 50 is always positioned to be exposed to the working space 20 (FIG. 2) for pumping the space while the other is positioned to be isolated in the zone 32 for reactivation. The power supply 39 is arranged to provide two levels of current to the getter panels 48 and 50 over cable 41; one over lines 131 and the other over lines 133. In the circuit of FIG. 6, lines 131 carry current sufficient to heat the getter panels to a temperature for pumping by sorption and the lines 133 carry a higher level of current sufficient to heat the getter panels to a temperature for reactivating the getter material. The currents delivered to the getter panels 48 and 50 are determined by a pair of conjointly movable blade assemblies 135 and 137 of a rotary switch 139. Each of the blade assemblies 135 and 137 has a pair of electrical contacts 141 and 143, respectively, for selectively connecting at one time one of the two lines 131 or the two lines 133 to the cables 89 and 91. The blade assemblies 135 and 137 are mechanically linked to turn in response to the translation of the drive shaft 35 of the motor 33 (FIG. 1). When the blade assemblies 135 and 137 are in the positions illustrated in FIG. 6, the getter panel 48 is isolated in the reactivation zone 32 and the pair of contacts 141 of the blade assembly 135 connect the pair of higher current carrying lines 133 to the cable 89 to heat the getter material of the panel 48 to its reactivation temperature. At the same time, the getter panel 50 is exposed to pump the working space 50 and the pair of contacts 143 of the blade assembly 137 connect the pair of lower current carrying lines 131 to the cable 91 to heat the getter material of the panel 50 to its sorption pumping temperature.

Upon articulation of the gas pumping members 14 to the other of its two positions, i.e., so that the ends of the members opposite those shown in FIG. 2 are positioned proximate one another, the getter panel 48 of each member 14 is exposed to pump the working space 20 and the getter panel 50 is isolated in the reactivation zone 32. This articulation is effected by operating the motor 33 to translate the drive shaft 35 to move the gears 107 and 109 (FIG. 5B) so that the ends of their quarter segments opposite that shown in FIG. 5B are engaged. This translation of the drive shaft 35 also causes the blade assembly 137 to rotate to position its pair of contacts 143 for connecting the pair of higher current carrying lines 133 to the cable 91 for heating the getter material of the isolated panel 50 to its reactivation temperature. In addition, the blade assembly 135 is rotated to position its pair of contacts 141 for connecting the pair of lower current carrying lines 131 to the cable 89 for heating the getter material of the exposed panel 48 to its sorption pumping temperature.

Continued periodic articulation of the gas pumping members 14 (FIG. 2) permits their getter panels 48 and 50 to alternately pump the working space 20 and be reactivated without interruption of the pumping of the space. However, if getter panels 48 and 50 become contaminated by pumped gases that are permanently fixed by the getter material (i.e., irreversibly sorbed), the panels must be replaced. This should not occur too frequently in thermonuclear fusion reactor applications, if the working space 20 is first pumped to a pressure of about $1\times10^{-3}$ torr by the diffusion pump 26. Very little of the permanently contaminating gases remain in the working space 20 after such pumping.

In accordance with the present invention, each gas pumping member can be constructed to have any number of distinct gas pumping surfaces. In the embodiment of the gas pump apparatus 10 illustrated in FIG. 2, two such surfaces are provided, one facing the working space 20 being pumped and one facing the isolated reactivation zone 32. However, the gas pumping member can be constructed to have more that two distinct pumping surfaces. For example, each gas pumping member 114 included in the embodiment of the gas pump apparatus 100 illustrated in FIG. 7 has three distinct elongated rectangular panels 80, 82 and 84 of gas capture material, such as the getter used in the gas pump apparatus 10 illustrated in FIG. 2. Each of the panels is supported for rotation with a shaft 174 by a triangular framework 146. In such embodiments of the gas pump apparatus 100, one getter panel 84 is positioned to face the reactivation zone 132 while two such panels 80 and 82 are positioned to face the working space 120 being pumped. Hence, one getter panel 84 is reactivated while two such panels 80 and 82 pump the space 120 to remove gas therefrom for eventual exhausting to the exterior by the exhaust system via the gas duct 122, as described hereinbefore with reference to FIG. 1.

A flexible metal rod 172 of the kind described with reference to FIG. 4C, extending the length of the framework 146, is supported by a bar 147 at each corner of the triangular framework to form gas tight seals between adjacent gas pumping members 114 and between any gas pumping member and an adjacent wall, such as walls 144 and 145 of the vessel 140 enclosing the working space 120 and reactivation zone 132. The gas tight seals formed between the engaged flexible metal rods 172, or the rods and an adjacent wall of the vessel 140 isolate the reactivation zone 132 form the working space 120. In many respects, the gas pump apparatus 100 is similar to the gas pump apparatus 10 described hereinbefore with reference to FIGS. 2–6. For example, the getter panel illustrated in FIG. 3 can be used to form the panels 80, 82 and 84. In addition, a housing 151 is provided for the drive mechanism used to rotate the gas pumping members 114, the housing, facing vessel walls 193 and gas pumping members provided with appropriate gas tight seal means between the opposite ends of the triangular framework and adjacent housing and vessel walls. However, instead of articulating the gas pumping members 114 in opposite direction to isolate and expose the panels 80, 82 and 84, the shaft 174 of each member is rotated in a single direction about its longitudinal axis to isolate the panels successively in the reactivation zone 132. Recesses 86 and 88 are defined by the walls 144 and 145, respectively, to extend the length of the gas pumping members 114 and provide clearance for the flexible metal rods 172 carried by the adjacent gas pumping members as the members are rotated.

To rotate all gas pumping members 114 in a single direction, a modified form of the chain drive mechanism 37 illustrated in FIGS. 5A and 5B is employed. More specifically, the quarter segment sprockets 95 (FIG. 5A) are replaced with fully circular sprockets and a single continuous loop chain is substituted for the two chains 98 and 99. The single loop chain encircles and engages diametrically opposite sides of all the circular sprockets. Moreover, the two circular chain drive sprockets 115 and 117 are replaced by a single circular chain drive sprocket. The shaft of the single chain drive sprocket is directly driven by a motor providing rotational drive, instead of the translational drive provided by motor 33.

To provide the proper current levels to the three getter panels 80, 82 and 84 of each gas pumping member 114, the circuit of FIG. 6 is modified, and an additional slip ring assembly with operatively associated connecting electrical cables are provided for the third getter panel. The circuit is modified by replacing the rotary switch 139 with one that always couples to lower current carrying lines 131 the two of the three getter panels 80, 82 and 84 exposed to the working space 120, while the remaining one of the three getter panels isolated in the reactivation zone 132 is coupled to the higher current carrying lines 133.

Figure 7:
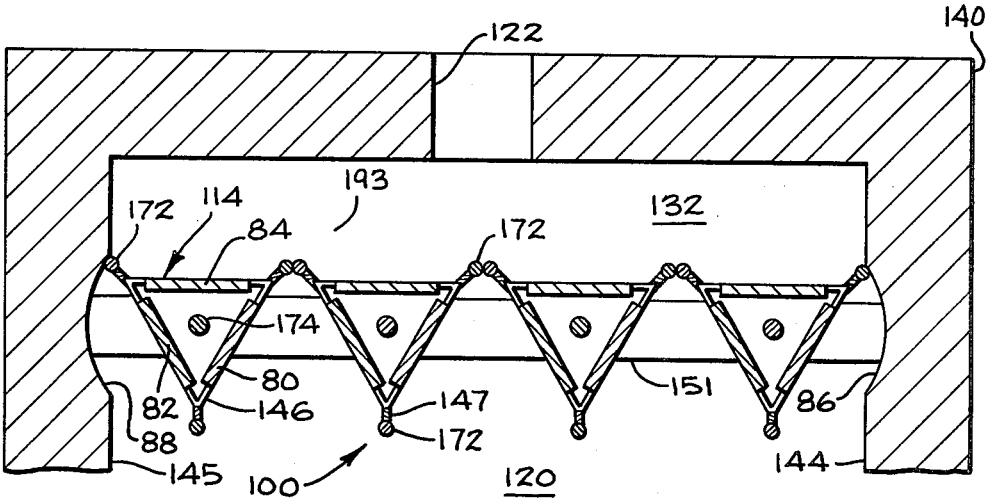
FIG. 7 is a cross-sectional view of another preferred embodiment of the gas pump apparatus of the present invention.

To pump the working space 120 continuously with the gas pump apparatus 100 shown in FIG. 7 the gas pumping members 114 are rotated in three steps to successively position each of the three getter panels 80, 82 and 84 in the reactivation zone 132 for liberation and removal of gas reversibly sorbed by the panels while exposed to the working space 120. This conditions the getter panels for further pumping of the space. At the same time, different pairs of getter panels are successively exposed to the working space 120 to remove by sorption gases found therein. Repetition of the rotation of the gas pumping members 114 and successive reactivation of them, one at a time, provides continuous pumping of the working space 120, because one substantially gas-free getter panel and one partially saturated getter panel are always exposed to the working space 120 for removing gases therefrom.

While the gas pump apparatus of the present invention has been described in detail in connection with a preferred embodiment arranged to pump high vacuum equipment, it will be appreciated by those skilled in the art that various changes and modifications can be made in adapting the invention to such uses or other different ones where it is desired to pump gas from a different working space. Therefore, it is intended that the scope of the invention not be limited other than by the terms of the following claims.

What I claim is:

1. A gas pump apparatus for pumping gas from a space; comprising:

an array of movable gas capture pumping members;

each of said pumping members defining a plurality of surfaces facing in different directions, each of said surfaces being constituted by material for capturing gas;

means for mounting said array of movable pumping members in a gas flow communication with said space in a number of different end-to-end positions to define a volume zone isolated from said space, at least one surface of each of said pumping members facing said space, a different surface of each of said pumping members facing said volume zone for different positions of said pumping members;

means for reactivating surfaces of said pumping members facing said volume zone; and means for moving said means for mounting to locate said pumping members in a selected one of said different positions.

2. The gas pump apparatus of claim 1 wherein each of the movable gas capture pumping members has a number of surfaces corresponding to the number of different mounting positions of said pumping members.

3. The gas pump apparatus of claim 2 wherein each of the pumping members has at least two gas capture surfaces.

4. The gas pump apparatus of claim 2 wherein each of the pumping members has three surfaces of substantially the same configuration and dimensions joined together to define, in cross section, an equilateral triangle.

5. The gas pump apparatus of claim 1 wherein said moving means moves said members together to locate each of said members in said selected one of said positions with a different surface of each member located at said volume zone for different positions of said each member.

6. The gas pump apparatus of claim 1 wherein each member of said array has the same number of said surfaces.

7. The gas pump apparatus of claim 6 wherein each member of said array has a number of surfaces corresponding to the number of different mounting positions for said each member.

8. The gas pump apparatus of claim 7 wherein each member of said array includes more than two of said surfaces, and one of said surfaces of each member is located at said volume zone and the other of said surfaces is located in gas flow communication with said space for each of the different positions of said members.

9. The gas pump apparatus of claim 8 wherein each member of said array includes three of said surfaces.

10. The gas pump apparatus of claim 1 further comprising a gas tight seal means located between the ends of each of said members to isolate said volume zone against gas flow between said volume zone and said space when each of said members is located in said different positions.

11. The gas pump apparatus of claim 10 wherein each of said members define a confronting surface for location proximate a confronting surface of an adjacent member when said member is located in each of said different positions, and said gas tight seal means includes a seal member mounted at each of said confronting surface of each member to engage a seal member mounted at the confronting surface of the adjacent member to isolate said volume zone against gas flow between said volume zone and said space when each of said members is located in each of said different positions.

12. The gas pump apparatus of claim 1 wherein the gas capture surfaces have a combined gas capture capacity that is selected so that the surfaces placed in gas flow communication with said space at any time maintain a selected steady state pressure in said space.

13. The gas pump apparatus of claim 1 wherein said array of movable gas capture pumping members is mounted within a vessel defining said space.

14. The gas pump apparatus of claim 1 wherein each pumping member includes more than two of said surfaces, and one of said surfaces of each member is located at said volume zone and each of the other of said surfaces is located in gas flow communication with said space for each of the different positions of said members.

15. The gas pump apparatus of claim 14 wherein each member of said array includes three of said surfaces.

16. The gas pump apparatus of claim 1 wherein the volume zone has a side facing in the direction of gas flow from said space of selected facing area, and each surface defined by said pumping members has an area greater than said facing area of said volume zone.

17. The gas pump apparatus of claim 1 wherein said surfaces are constituted by getter material.

18. The gas pump apparatus of claim 1 further comprising:

means for reactivating surfaces located at said volume zone whereby captured gases are freed from said surfaces; and means for removing gases freed from said surfaces located at said volume zone to a place other than said zone and said space.

19. The gas pump apparatus of claim 18 further comprising:

means coupled to the pumping members for maintaining said surfaces at a temperature conducive to the capture of the gas found in said space; and means for altering the temperature of at least the surface at said volume zone to free gases captured by said surfaces.

20. The gas pump apparatus of claim 19, wherein said means for altering the temperature of said surfaces includes electrical heating means embedded in said surfaces of said pumping members.

* * * * *